US010988870B2

(12) United States Patent
Verscheure

(10) Patent No.: US 10,988,870 B2
(45) Date of Patent: Apr. 27, 2021

(54) DEVICE FOR CUTTING THROUGH PILE THREADS ON A WEAVING MACHINE

(71) Applicant: NV MICHEL VAN DE WIELE, Kortrijk / Marke (BE)

(72) Inventor: Diederik Verscheure, Iziegem (BE)

(73) Assignee: NV MICHEL VAN DE WIELE

( * ) Notice: Subject to any disclaimer, the term of this patent is extended or adjusted under 35 U.S.C. 154(b) by 71 days.

(21) Appl. No.: 16/317,478

(22) PCT Filed: Jul. 17, 2017

(86) PCT No.: PCT/IB2017/054297

§ 371 (c)(1),
(2) Date: Jan. 11, 2019

(87) PCT Pub. No.: WO2018/011770

PCT Pub. Date: Jan. 18, 2018

(65) Prior Publication Data

US 2019/0301060 A1 Oct. 3, 2019

(30) Foreign Application Priority Data

Jul. 15, 2016 (BE) ..... 2016/0129

(51) Int. Cl.
*D03D 39/24* (2006.01)
*D03D 39/18* (2006.01)
*D03D 49/00* (2006.01)

(52) U.S. Cl.
CPC ..... *D03D 39/18* (2013.01)

(58) Field of Classification Search
CPC ..... D03D 27/10; D03D 27/06; D03D 39/18; D03D 39/16; D03D 39/00; D03D 47/275; F16J 1/12; Y10T 29/49288; Y10T 29/49929; Y10T 74/2142
See application file for complete search history.

(56) References Cited

U.S. PATENT DOCUMENTS 405,144 A 6/1889 Oswald
2,679,265 A * 5/1954 Adamson ..... D03D 39/18 139/43

(Continued)

FOREIGN PATENT DOCUMENTS

EP 1 122 348 8/2001

OTHER PUBLICATIONS

International Search Report and Written Opinion dated Oct. 24, 2017.

*Primary Examiner* — Robert H Muromoto, Jr.
(74) *Attorney, Agent, or Firm* — Fresh IP PLC; Clifford D. Hyra; Aubrey Y. Chen

(57) ABSTRACT

A device for cutting through pile threads on a weaving machine, including a cutting means (6), connected to a transmission body (5), and a rotatable drive means (1), which rotates alternately in the one and the other rotational direction and meshes with the transmission body (5) so that its rotation motions are converted into a back-and-forth displacement of the cutting means (6), wherein, via the transmission body (5), a pushing force is exerted on the cutting means (6). The transmission body (5) can be non-endless and interact with one rotatable drive means (1). Also, a weaving machine provided with such a cutting device.

21 Claims, 5 Drawing Sheets

(56) References Cited

U.S. PATENT DOCUMENTS

| | | | | | |
|---|---|---|---|---|---|
| 3,999,580 | A * | 12/1976 | Sparling | D03D 47/275 | 139/449 |
| 4,085,700 | A * | 4/1978 | Engels | D06C 23/02 | 118/37 |
| 4,526,209 | A * | 7/1985 | Pharr | D03D 39/20 | 139/21 |
| 4,561,473 | A * | 12/1985 | Yonehana | D03D 39/18 | 139/21 |
| 4,655,863 | A * | 4/1987 | Franco | D04H 11/04 | 139/1 R |
| 4,825,547 | A * | 5/1989 | Carder | B26B 15/00 | 26/13 |
| 4,831,737 | A * | 5/1989 | Grund | B23Q 11/0003 | 33/702 |
| 6,854,436 | B1 * | 2/2005 | English | F01L 1/146 | 123/90.61 |
| 6,877,398 | B2 * | 4/2005 | Wirtz | F15B 15/1457 | 29/517 |
| 7,163,069 | B2 * | 1/2007 | Bauer | E21B 17/00 | 175/320 |
| 9,080,266 | B2 * | 7/2015 | Debaes | D03D 27/10 | |
| 9,297,096 | B2 * | 3/2016 | Debaes | D03D 15/0033 | |
| 9,580,844 | B2 * | 2/2017 | Debaes | D03D 27/10 | |
| 2004/0031351 | A1 * | 2/2004 | Wirtz | F16F 9/3221 | 74/579 R |
| 2004/0216928 | A1 * | 11/2004 | Bauer | E21B 17/00 | 175/320 |
| 2008/0230138 | A1 * | 9/2008 | Mueller | D03D 39/18 | 139/22 |
| 2009/0302168 | A1 * | 12/2009 | Hetrick | B64C 27/72 | 244/214 |
| 2013/0000772 | A1 * | 1/2013 | Tang | D03D 27/06 | 139/37 |

* cited by examiner

DEVICE FOR CUTTING THROUGH PILE THREADS ON A WEAVING MACHINE

This application claims the benefit of Belgian patent application No. BE-2016/0129, filed Jul. 15, 2016, which is hereby incorporated by reference in its entirety.

FIELD OF THE DISCLOSURE

This disclosure relates to a device for cutting through pile threads on a weaving machine, comprising a cutting means, which is displaceable back and forth according to a substantially rectilinear motion path, a transmission body in connection with the cutting means, and a rotatable drive means, which is drivable so as to rotate alternately in the one and the other rotational direction, wherein the drive means and the transmission body are provided to interact in order to convert the rotation motions of the drive means, via the transmission body, into a back-and-forth displacement of the cutting means.

This disclosure also relates to a weaving machine equipped with such a device for cutting through pile threads.

There exist a variety of weaving methods in which pile threads are automatically cut through, during the execution of a weaving process on a weaving machine, by a reciprocating cutting blade. Such weaving methods are executed on very different weaving machines, both on face-to-face weaving machines and on single-face weaving machines, such as, inter alia Axminster looms.

More specifically, this disclosure relates, for example, to a device for cutting through the pile threads, extending between two ground fabrics of a face-to-face fabric on a face-to-face weaving machine. In other possible applications, this disclosure relates to a device for cutting through pile threads which extend, on a single-face weaving machine, between a pile yarn store or pile yarn supply means and means for introducing pile yarns during a weaving process, such as for cutting through the pile yarns, which are to be woven in, on an Axminster loom. Of course, this list of possible applications is not exhaustive and is by no means limiting, and the invention is usable for cutting through pile threads on any type of weaving machine and in the execution of any weaving method whatsoever.

BACKGROUND

A known cutting device is described in Patent EP 1 122 348 B1 and comprises a cutting device having the characteristics which were indicated in the first paragraph of this description. An endless toothed belt made of flexible material is connected to a blade carriage and runs over the full width of a face-to-face weaving machine in a closed circuit over two gearwheels, which are each arranged on a respective side of the weaving machine. The teeth of the toothed belt are located in respective interspaces between the teeth of the gearwheels. A motor drives one of the gearwheels alternately in the one and the other rotational direction. The gearwheel here exerts, via the interacting teeth of the gearwheel and the toothed belt, a directionally alternating pulling force on the toothed belt, whereby the toothed belt is displaced, running over the two gearwheels, alternately in the one and the other rotational direction. The blade carriage is hereby displaced back and forth in order to cut through the pile threads of a face-to-face fabric during a weaving process.

Similar cutting devices are described in patent application DE 19536002A1 and EP 1217115A1.

These cutting devices have the drawback, however, that they take up a lot of space on a weaving machine, since at both ends of the cutting path there must be provided a gearwheel, and since the toothed belt must extend over the full cutting path of the cutting means in a closed circuit. As a result, the mounting of such a device on a weaving machine is not simple.

Moreover, the presence of at least two gearwheels and the long endless toothed belt of relatively large mass increases the inertia of the moving parts of the cutting device. This also increases the energy consumption and limits the maximally attainable weaving speed. Also the position certainty of the blade carriage during the cutting process leaves hereby much to be desired. In order to counter that, detection means to detect this position, and means to secure the position certainty must be provided.

The toothed belt must also be kept under a sufficiently high tension to avoid a situation in which it detaches from one of the gearwheels or in which the teeth of the toothed belt fall out of alignment with the gearwheel teeth. This can cause an interruption of the weaving process. Thus this toothed belt tension must be well monitored and, if a too low tension is detected, action has to be taken. Since the tension of the drive belt must be fairly high, there is also quite a high risk that an incorrect and excessive tension will lead to a rupture of the drive belt. The rupture of a toothed belt of this type under high tension implies a safety risk for the operator of the weaving machine. Detection and tension-regulating means are thus necessary to keep the tension of the toothed belt within certain limits, so that the proper working of the cutting device is ensured, whilst safety risks are also as far as possible avoided.

SUMMARY

An object of embodiments of this invention is to remedy at least a number of the above-indicated drawbacks.

This object may be achieved by providing a cutting device having the characteristics from the first paragraph of this description, which cutting device is provided to exert, by a rotation motion of the drive means, via the transmission body, a pushing force on the cutting means.

As a result, one rotatable drive means can suffice to realize the back-and-forth motion of the cutting means via a transmission body, without the need for other rotatable elements, such as reversing gearwheels and the like.

This cutting device can hence be constructed such that it takes up less space on a weaving machine, whilst the moving parts also have a lower inertia. This is beneficial to the energy consumption and increases the maximally attainable weaving speed. Moreover, with such a cutting device, greater position certainty of the cutting means is achieved.

The transmission body can be a rigid body, such as a toothed rack, or can also be a flexible body. The latter means that the transmission body is flexible over at least a portion of its length. As will further appear from this description, the flexibility can be variable over the length of the transmission body and the transmission body can have one or more flexible zones along with one or more zones which are rigid or which have a very small flexibility.

Preferably, the transmission body is flexible over at least a portion of its length.

Through the provision of a flexible transmission body, this can be bent around a portion of the circumference of the drive means, so that the interaction between drive means and transmission means can be realized over a greater length than with a rigid transmission body, such as, for example, a toothed rack. When the drive means, for example, is provided with teeth, a greater length of a flexible transmission body can mesh with these teeth. This ensures a better force distribution over a larger number of teeth. In the situation in which the cutting means is located on that side of the weaving machine where the drive means is placed, a fairly long part of the transmission body is found past the drive means outside of the cutting path.

When the transmission body is flexible, the said part of the transmission body can, in a preferred embodiment, be led back below or above the level of the motion path of the cutting means (given a horizontal rotation axis of the drive means), or in front of or behind the vertical plane of this motion path (given a vertical rotation axis of the drive means), so that no additional space has to be provided for this next to the weaving machine.

This involves a considerable saving in space. After all, the length of the said part of the transmission body can be very large. This length can for example be approximately equal to the weaving width of the weaving machine.

Preferably, the body is elongate, for example in the form of a ribbon, a strip, a band, or a belt. The stiffness of the transmission body can be the same over the full length thereof, but can also vary according to its longitudinal direction.

In this Patent Application, by 'the stiffness' of the transmission body, is meant the bending stiffness per unit of length. The bending stiffness (in $N \cdot m^2$) is the product of the modulus of elasticity or Young's modulus (E) and the moment of inertia (I). This concerns the bending stiffness by applying a force perpendicular to the cutting plane. This is the plane according to which the pile threads are cut through by the cutting means. If the cutting means follows a horizontal motion path and cuts through the pile threads according to a horizontal cutting plane, the stiffness is here meant under the influence of a vertical force. If the transmission means is band-shaped, for example, having two parallel, relatively wide sides and two flanks of limited height, the force is directed perpendicular to the two wide sides.

For their mutual interaction, the drive means and the transmission body can be provided with respective engagement means, which allow a transmission of motion. These engagement elements are preferably positive-locking. For the drive means, these are, for example, one or more teeth or projections. For the transmission body, these are, for example, one or more corresponding teeth or openings, or a surface in which one or more recessed zones or a relief structure are provided.

The interaction between the drive means and the transmission body can also be realized by virtue of the fact that the transmission body is in contact with a surface of the drive means, whilst the frictional resistance is sufficient to displace the transmission body. The mutual position of the transmission body and the circumference of the drive means can also be fixed by means of a locking means. This locking can be permanent or can only be achieved during the rotation of the drive means.

In a preferential embodiment, the drive means and the transmission body are provided to displace the cutting means back and forth in successive motion cycles and to exert on the cutting means, during each motion cycle, alternately a pushing force and a pulling force.

Both during the forward motion and during the return motion of the cutting means, a row of pile threads is cut through. Thus, during one motion cycle of the cutting means, at least two weaving cycles take place.

In a particularly practical embodiment, the transmission body will firstly exert a pushing force on the cutting means during the forward motion in order to push it away from the drive means from standstill and speed it up to a maximum velocity, and will subsequently exert a pulling force on the cutting means in order to slow this down again, during its further displacement away from the drive means, to a standstill at the place where the motion changes direction. During the return motion, the transmission body will firstly exert a pulling force on the cutting means in order to pull it towards the drive means from standstill and speed it up again to a maximum velocity, and will subsequently exert a pushing force on the cutting means in order to slow this down again to a standstill at the place where the motion cycle began.

In another embodiment, the transmission body will, during one or more weaving cycles, exert no force on the cutting means, whereby the cutting means remains stationary on the side of the weaving machine. A longer standstill of this type can be used, for example, in order to grind the cutting means.

The transmission body is preferably a non-endless body. Such a transmission body does not have to be kept under tension in order to keep it on its motion path and in order to keep it in interaction with the rotatable drive means.

In a very preferential embodiment, the transmission body is in interaction with one single rotatable drive means. Such a cutting device has a particularly low inertia and can be driven at a high velocity, whilst the position certainty of the cutting means is excellent.

In a particularly advantageous embodiment, the rotation axis of the drive means is practically transversely to the direction of the motion path. This allows the rotation motion of a rotatable drive means to be converted via the transmission body into a linear velocity which is practically equal to the peripheral velocity of the drive means. The rotation axis of the drive means can be either horizontal or vertical, given a horizontal motion path of the cutting means.

Preferably, the drive means comprises a rotation shaft and the drive means is driven by a motor whereof the motor shaft is practically parallel to, or lies in line with, the said rotation shaft of the drive means. This makes it possible to place the motor inside the existing width of the weaving machine.

The rotation of the motor shaft is here preferably transmitted directly to the rotation shaft of the drive means. In this way, the inertia of the moving parts is kept to a minimum, whilst the cutting device is very reliable.

In an alternative embodiment, the rotation of the motor shaft is transmitted, via transmission means having a transmission ratio of no more than 10, to the rotation shaft of the drive means. The transmission ratio is preferably 4, very preferentially 2 or 1. The transmission means comprise, for example, a single stage gear transmission.

In order to realize the back-and-forth motion of the cutting means, two motors can be placed one opposite the other and coupled together. This can be regarded as one equivalent long motor. A long motor normally has less inertia than one larger motor of greater diameter.

The transmission body is preferably an elongate flexible body and preferably comprises at least two zones, extending according to the longitudinal direction and having a mutually different stiffness.

The said zones of the transmission body have, for example, a different stiffness, since the transmission body has in these zones a mutually different cross section or a mutually different material composition, or since one zone of the transmission body is constructed with reinforcing ribs.

The transmission body can comprise in at least one zone also a stiffening means. The natural stiffness of the basic material of the transmission body can hence be increased in one or more zones. In different zones a different stiffness can be realized, since the transmission body in these zones comprises a respective stiffening means having a different stiffness-enhancing effect. In two zones of different stiffness, the one zone can comprise a stiffening means and the other zone not.

The stiffening means is preferably incorporated in the basic material of the transmission body and comprises, for example, stiffness-enhancing fibres, such as carbon fibres, glass fibres or aramid fibres and the like, or combinations of two or more different types of fibres. The greater the relative quantity of fibres which is incorporated in the basic material, the greater is the stiffness which is obtained. By providing in the basic material of the transmission body two or more zones having a different relative quantity of fibres, zones having a different stiffness are obtained. The stiffening means can also be incorporated in the basic material of the transmission body in the form of one or more stiffness-enhancing layers. The stiffness-enhancing layers can consist, for example, of one or more materials having a relatively high stiffness, such as, for example, metals. In this way, a thin band of steel, inter alia, could be used. The stiffness-enhancing layers can also consist of a composite with fibre reinforcement. Such a layer comprises, for example, fibres or a fabric of fibres and a matrix material which holds the fibres together. The fibres are, for example, carbon fibres, glass fibres or aramid fibres and the like, or combinations of two or more different sorts of fibres.

The basic material of the transmission body is preferably a composite material, for example based on an epoxy matrix with polyester fibres. This basic material preferably also has a layered structure. For example, a plurality of plastics layers are provided, having approximately the same thickness. In order to increase the stiffness in one or more zones, one or more polyester layers in these zones are replaced by carbon layers. In this way, the polyester layers, for example per pair of two polyester layers lying one upon the other, are replaced by one respective carbon layer having a thickness which tallies with the combined thickness of the pair of polyester layers.

For example, in a zone with relatively small stiffness, a plurality of polyester layers, which each have a thickness of approximately 0.1 mm, are provided. In zones with a greater stiffness, one or more pairs of polyester layers are replaced by one respective carbon layer having a thickness of approximately 0.2 mm.

The transmission body is preferably provided on at least one side with a layer having a low frictional resistance, such as, for example, a Teflon layer.

The stiffness of the transmission body is determined, inter alia, by the quantity of fibres incorporated therein, by the number of stiffness-enhancing layers, by the thickness of each layer, by the distance between different layers, and by the location of each layer with respect to the neutral line of the transmission body. The more remote a layer is from the neutral line, the greater is its stiffness-enhancing effect.

The stiffness-enhancing effect of a fibre-reinforced layer is also dependent on the quantity of fibres which are incorporated in the layer. The quantity of carbon fibres in a carbon fibre-reinforced layer lies, for example, between 10% (volume percentage) for a carbon layer having a low stiffness-enhancing effect and 90% for a carbon layer having a very high stiffness-enhancing effect. Generally, the carbon fibres volume percentage between 40% and 90% is used, preferably between 50% and 80%. A typical value lies between 60% and 80%. The stiffness-enhancing effect of a fibre-reinforced layer is also determined by the type of fibres. In this way, in order to obtain a fibre-reinforced layer with low stiffness-enhancing effect, polyester fibres, for example, will be used.

The stiffness of one or more zones of the transmission body can also be influenced by fastening a stiffening means externally to the basic material of the transmission body. Such external stiffening means can consist, for example, of a light metal, such as aluminium, titanium or a fibre-reinforced plastic. The stiffening means then has, for example, the shape of a relatively slender strip or profile, which is fastened to one side of the transmission body, for example by gluing. Preference is given to an external stiffening means having a relatively large height, because this delivers a high stiffness-enhancing effect, and a limited width in order to keep the weight of the stiffening means as low as possible.

Two or more of the above-indicated measures for increasing the stiffness (adding into the basic material fibres or stiffness-enhancing layers, such as, inter alia, fibre-reinforced layers, or provision of an external stiffening means) can be applied in different zones of one and the same transmission body, or else can be combined in one and the same zone.

In a strongly preferential embodiment, the transmission body comprises at the one end a head part which is connected to the cutting means, and at the other end a tail part, and the stiffness of the head part is 15 to 100 times greater than the stiffness of the tail part.

In certain embodiments, the head part bears the greatest mass. This is, inter alia, the case when the cutting means is fastened on a blade carriage, whilst the blade carriage is connected to the transmission body. This portion of the transmission body will thus encounter the largest pressure forces and consequently has the greatest risk of buckling. For this reason, the head part is constructed with a relatively large stiffness. For the driving, more specifically for the contact between the transmission body and the drive means, this should not be considered a drawback, since this portion of the transmission body also must not to be fully bent over the circumference of the drive means.

The tail part of the transmission body is subjected substantially to tensile stresses. This part can thus be much more flexible. This is also favourable to a smooth reliable interaction between the drive means and the transmission body. After all, it is the tail part which in each motion cycle has to be bent over the circumference of the drive means.

In a preferred embodiment the stiffness of the transmission body decreases gradually or incrementally from the head part up to the tail part.

The stiffness of the head part can preferably lie between 1 $N \cdot m^2$ per metre and 500 $N \cdot m^2$ per metre, whilst the stiffness of the tail part lies between 0.1 $N \cdot m^2$ per metre and 1 $N \cdot m^2$ per metre.

Preferably, a transmission means whereof the head part has a stiffness which lies between 5 $N \cdot m^2$ per metre and 100 $N \cdot m^2$ per metre, and whereof the tail part has a stiffness between 0.15 $N \cdot m^2$ per metre and 0.5 $N \cdot m^2$ per metre, is used.

In the most preferential embodiments, the stiffness of the head part lies between 5 $N \cdot m^2$ per metre and 10 $N \cdot m^2$ per metre when internal fibre-reinforced layers are provided, and between 75 $N \cdot m^2$ per metre and 90 $N \cdot m^2$ per metre when an external stiffening means is provided.

Example 1 a band having a rectangular cross section with 13 mm and 4 mm sides, provided with teeth having a tooth width of 4.3 mm:

The head part has a stiffness of 5.65 $N \cdot m^2$ per metre

The tail part with teeth has a stiffness of 0.17 $N \cdot m^2$ per metre

Example 2 a band having a rectangular cross section with 28 mm and 1.3 mm sides, provided with teeth having a tooth width of 8.0 mm:

The head part of the band alone, without external stiffening rib, has a stiffness of 0.42 $N \cdot m^2$ per metre When the head part is provided with an external stiffening rib, the stiffness becomes 83.8 $N \cdot m^2$ per metre The tail part with teeth has a stiffness of 0.30 $N \cdot m^2$ per metre.

Example 3 a band having a rectangular cross section with 28 mm and 1.0 mm sides, provided with teeth having a tooth width of 8.0 mm:

The head part of the band alone, without external stiffening rib, has a stiffness of 0.62 $N \cdot m^2$ per metre When the head part is provided with an external stiffening rib, the stiffness becomes 83.8 $N \cdot m^2$ per metre The tail part with teeth has a stiffness of 0.45 $N \cdot m^2$ per metre In a particularly preferential embodiment, the cutting means comprises a carrier, which is connected to the transmission body, the carrier bears a blade, the cutting device comprises a cutting means guide extending along the motion path and having at least one carrier guide surface on which the carrier is displaceable back and forth, and the carrier is provided with detaining means in order to detain this carrier during its displacements over the carrier guide surface with respect to the guide surface. Such a carrier is also referred to as a blade carriage.

The detaining means ensure the position certainty of the cutting means in the vertical direction. The detaining means comprise, for example, at least one guiding edge of the carrier, which is located below at least one edge of the cutting means guide and allows a displacement of the carrier over the guide surface, but prevents the carrier from moving away from the guide surface. In another embodiment, the cutting means guide comprises a guide channel for the transmission body and the transmission body is detained in the vertical direction in that channel, since the top side of the channel is closed or has a width which, at least in some places, is narrower than the width of the transmission body.

In an advantageous embodiment of the cutting device, the device comprises guide means for keeping the transmission body in interaction with the drive means. These guide means may also take the form of rolling means or bearing means, such as, for example, one or more rollers, which hold the transmission body locally in place, or a kind of endless pressure band, which itself is tensioned over two rollers.

The guide means are preferably also equipped with cooling means. Especially if the transmission body is a flexible body and is bent around a portion of the circumference of the drive means, reaction forces act between the transmission body and the guide means. These reaction forces give rise to friction, heat build-up and wear. Therefore, such zones can be better cooled.

The cooling means are, for example, guide blocks, which are provided with cooling channels and/or cooling ribs. For the lubrication, a Teflon layer can be provided on the contact side of the transmission body and/or lubricant can be applied at discrete places, for example by means of a lubricating block, which, during the motions, makes contact with the transmission body.

In order to guide the transmission body also outside of the cutting path, one or more guide surfaces for the transmission body are preferably provided past the drive means. Preferably there is provided a guide channel in which the transmission body is displaced back and forth and is led sideways. Preferably, this channel is also on the top side at least partially closed, so that a guide tunnel for the transmission body is formed. Such a channel makes the cutting device safer.

In a most preferential embodiment of the cutting device, the drive means comprises a number of first engagement means, and the transmission body comprises a number of second engagement elements, which are provided to interact with the first engagement elements in order to convert the rotation motions of the drive means, via the transmission body, into a back-and-forth displacement of the cutting means. The second engagement elements are, for example, teeth, openings or recessed zones, whilst the first engagement elements are teeth.

The transmission body can be provided on at least one side with a series of second projections, which are distributed at mutual intervals over at least a portion of the length of the transmission body, whilst the drive means comprises a series of first projections, which project from a peripheral rim and are distributed at mutual intervals over at least a portion of the circumference of the drive means. The transmission body is positioned along the circumference of the drive means, preferably along a portion of the circumference thereof. The first projections of the drive means and the interspaces between these first projections are placed and shaped such that at least one second projection, preferably a plurality of second projections, of the transmission body are located in respective interspaces between first projections. The first and second projections are preferably positive-locking, such as, for example, teeth. The drive means can be a gearwheel, whilst the transmission body is a toothed rack or a toothed belt.

In an alternative embodiment, the transmission body comprises openings, which are distributed at mutual intervals over at least a portion of the length of the transmission body, whilst the drive means comprises a series of projections, which project from a peripheral rim and are distributed at mutual intervals over at least a portion of the circumference of the drive means. The transmission body is positioned along the circumference of the drive means, preferably running along a portion of the circumference thereof. The projections of the drive means and the interspaces between these projections are such that in at least one opening, preferably a plurality of openings, of the transmission body a respective projection of the drive means is found. The projections are preferably teeth. Here the drive means can here also be a gearwheel, whilst the transmission body is band-shaped, preferably is constructed as a band. Most preferably, the transmission body is a semi-rigid band.

By the rotation of the drive means, a pushing force is exerted on the transmission body, through which it is displaced.

The projections of the drive means can engage in the openings of the transmission body, or in interspaces between second projections of the transmission body, so that the drive means, by virtue of its rotation, can displace the transmission body.

The rotatable drive means having first engagement elements can be drivable by means of a motor with reversible rotational direction. The rotational direction of the rotation of the drive means is then reversed by the reversal of the rotational direction of the motor. The rotation of the motor in one specific rotational direction can also be converted with known means into a rotation of the rotatable drive means with alternating rotational direction.

Preferably, a motor with low inertia is employed. This can be any type of motor, but preferably a motor with water cooling is provided. A servo motor is well suited for this purpose.

BRIEF DESCRIPTION OF THE DRAWINGS

In the hereinafter following description, a drive device according to this invention is described in detail. The sole aim of this detailed description is to indicate how the invention can be realized and to illustrate the particular characteristics of the invention and, where necessary, to expound on these. This description can thus not be regarded as a limitation of the scope of this patent protection, nor of the field of application of the invention.

In this description, reference is made on the basis of reference numerals to the accompanying figures, whereof

DETAILED DESCRIPTION

On a face-to-face weaving machine, two pile fabrics are woven simultaneously. For this purpose, two ground fabrics are woven one above the other, consisting of weft threads and warp threads, whilst pile warp threads are alternately bound in into the upper ground fabric and into the lower ground fabric. In this way, a face-to-face fabric having pile warp threads which extend between the upper and the lower ground fabric is obtained. In order to separate the two pile fabrics one from the other, the pile warp threads extending between the two ground fabrics have to be cut through. This is done automatically by means of a blade carried by a blade carriage.

During a weaving cycle, the blade carriage is displaced over the width of the weaving machine, so that a following row of pile threads is cut through by the blade. The blade carriage forms part of a cutting device according to an embodiment of this invention.

Figure 1:
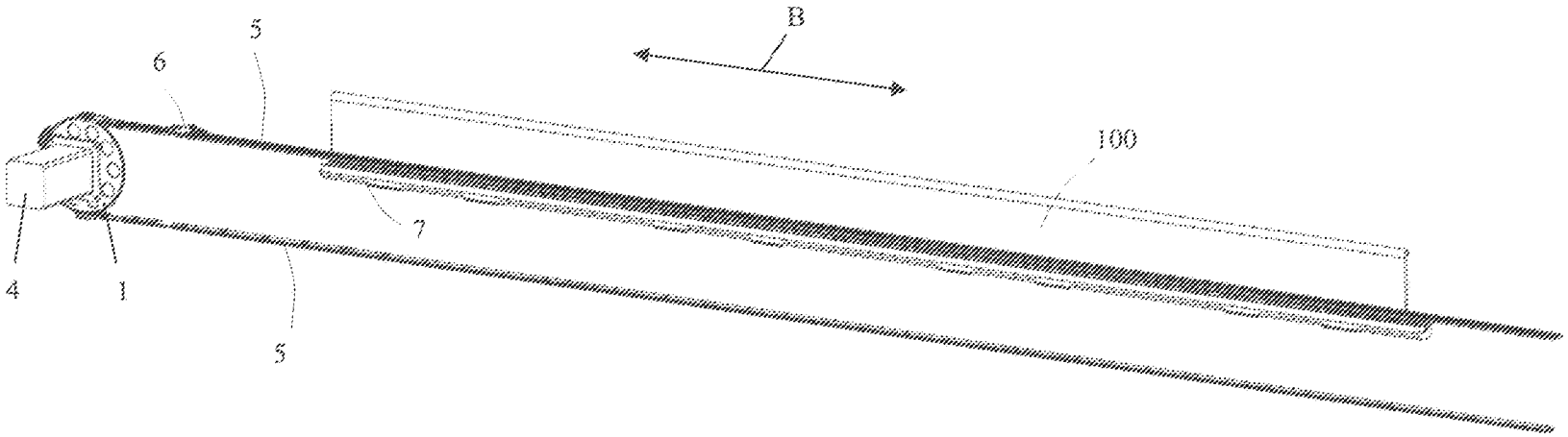
FIG. 1 is a schematic representation of a portion of a weaving machine which is provided with a cutting device according to an embodiment of the invention.

In FIG. 1, this cutting device is represented. It extends according to the lateral direction (B) of the weaving machine and is located before the weaving reed (100) on the side where the finished face-to-face fabric (101) is found.

The device comprises a drive gear (1), which is fastened on the horizontal motor shaft (3) of a servo motor (4). This motor shaft (3) is perpendicular to the lateral direction (B) of the weaving machine.

The drive gear (1) is provided on its rim with teeth (2), which are distributed at equal intervals over the circumference thereof. A flexible band (5) with openings (21)—see FIG. 7*a*—is led over half the circumference of the drive gear (1), whilst the successive teeth (2) of the drive gear (1) are found in respective successive openings (21) of the band (5).

As a result, the band (5) can be transported by the rotating drive gear (1) and the rotation motions of the drive gear (1) can be converted into a displacement of the band (5). The band (5) has a head part (5*a*), to which a blade carriage (6) is fastened, and a tail part (5*b*), in which the said openings (21) are provided.

A horizontal blade carriage guide (7) extends from the top of the drive gear (1), in a straight line according to the lateral direction (B) of the weaving machine, over the total cutting path which has to be covered in order to cut through all the pile threads of a row. Both the blade carriage (6) and the band (5) are displaceable according to the longitudinal direction of the blade carriage guide (7), but are detained with respect to this blade carriage guide (7).

The servo motor (4) can be controlled by a control device (not represented in the figures) so as to rotate alternately in the one and the other rotational direction during the weaving process.

In the blade carriage guide (7) a straight guide channel (8) is formed, in which the band (5) is displaceable. The channel has a cross section in the shape of an inverted T, wherein the opening at the top is narrower than the width of the band (5), so that this band (5) cannot leave the guide channel (8).

The blade carriage (6) comprises a plate-like base part (9). In the head part (5*a*) of the band (5) openings (20) are provided for the fastening of the blade carriage (6) to the band (5). The fastening is realized with bolts (18), which are fitted from the bottom side of the band (5) through the openings (20) and sit with the bolt shanks in openings through the base part (9), and nuts (19), which are fitted on the bolt shanks projecting on the top side of the base part (9).

Figure 5:
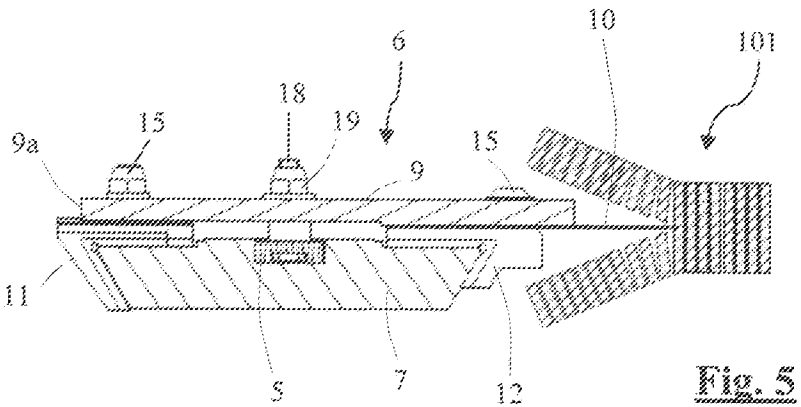
FIG. 5 represents a cross section of the blade carriage on the blade carriage guide according to the axis A-A in FIG. 3, during the cutting through of the pile threads between the two fabrics of a face-to-face fabric.
Figure 3:
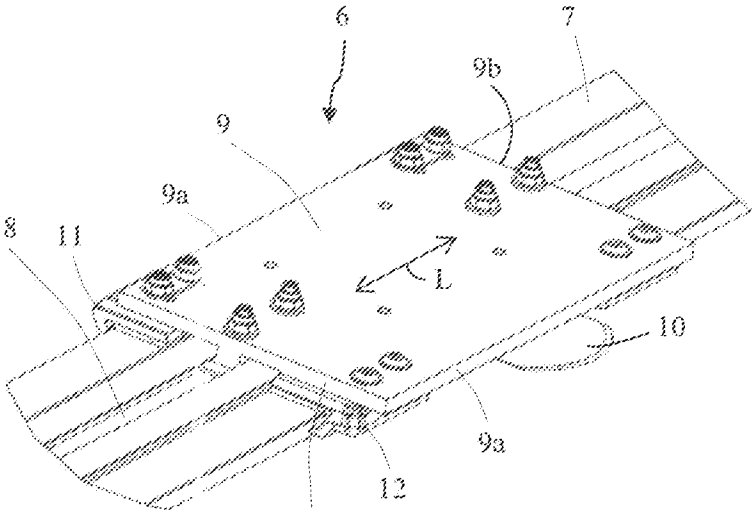
FIG. 3 represents the blade carriage and a portion of the blade carriage guide in perspective view.
Figure 4:
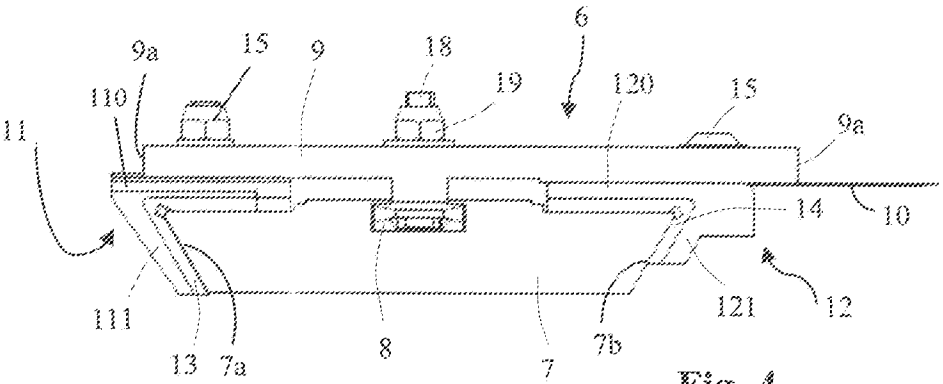
FIG. 4 represents a side view of the blade carriage on the blade carriage guide according to FIG. 3.

The base part (9) is substantially rectangular, having two parallel first sides (9*a*) which extend according to the longitudinal direction (L) of the blade carriage guide (7), and two parallel second sides (9*b*), which extend transversely to this longitudinal direction (L). The base part (9) is provided with a blade (10) on the first side (9*a*), which is directed towards the face-to-face fabric (101) (see FIG. 5). The blade (10) projects past the edge of the base part (9) and has an edge in the shape of a circular arc. The blade carriage (6) is produced from a light material such as, for example, aluminium or a composite material.

On the bottom side of the plate-like base part (9) two guide pieces (11) are provided, (12), which extend in parallel side by side according to the said longitudinal direction (L). Each guide piece (11), (12) comprises two wings (110), (111); (120), (121), which connect to each other forming an obtuse angle. Each guide piece (11), (12) is fastened by one of the wings (110), (120) against the horizontal bottom side of the base part (9) with a respective screw (15). The other wings (111), (121) of the guide pieces (11), (12) run obliquely towards each other in the downward direction.

The obliquely converging wings (111),(121) extend along the obliquely converging flanks (7*a*), (7*b*) of the blade carriage guide (7), so that the blade carriage (6) is held on the blade carriage guide (7) during its displacements.

Against those sides of the guide pieces (11), (12) which are directed towards the blade carriage guide (7) wearing parts (13), (14) are fastened.

In order to keep the band (5) in interaction with the teeth (2) of the drive gear (1), four guide elements (16) are provided along the length of the path over half the circumference of the drive gear (1). The contact with the moving band (5) causes a build-up of heat. In order to avoid a situation in which the guide elements (16) become too hot, these are provided with cooling fins (16*a*), whether or not in combination with openings and/or channels which facilitate a cooling air circulation.

Figure 2:
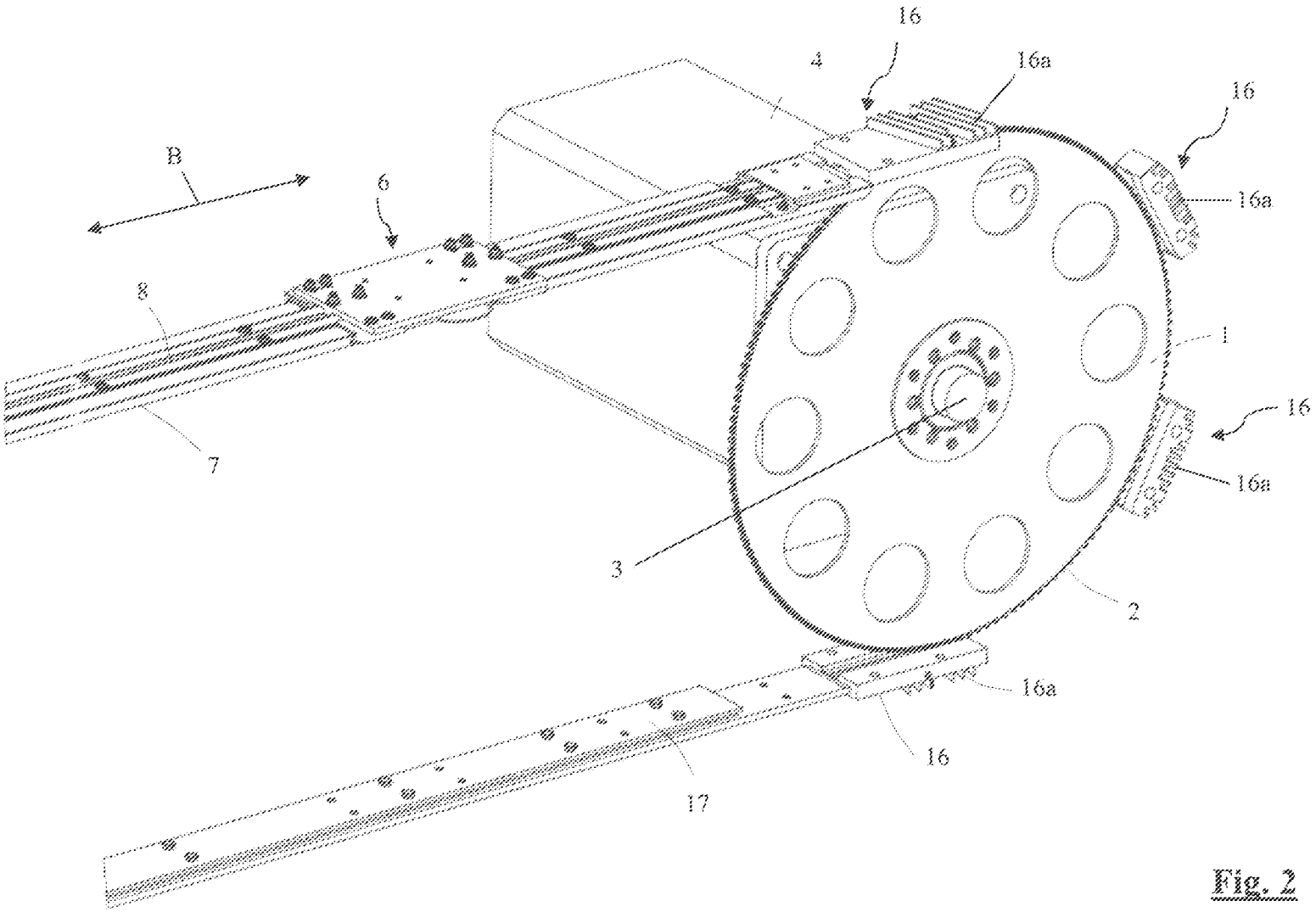
FIG. 2 represents a portion of the cutting device according to an embodiment of the invention in perspective view.

In the region of the bottom rim of the drive gear (1) a horizontal band guide (17) is provided, which extends in a straight line according to the lateral direction (B) of the weaving machine. In this band guide (17) a tunnel is formed, in which the band (5) can be displaced back and forth. When the blade carriage (6), in the embodiment of FIG. 2, is in its extreme left position, a relatively long length of the band (5) will be found in the blade carriage guide (7), so that the portion which is located outside of the cutting path past the drive gear (1) will be relatively short. As the blade carriage (6) shifts more to the right, the length of this portion will increase. The band guide (17) is required to guide that portion of the band (5) which is found at the bottom past the drive gear (1).

Figure 6:
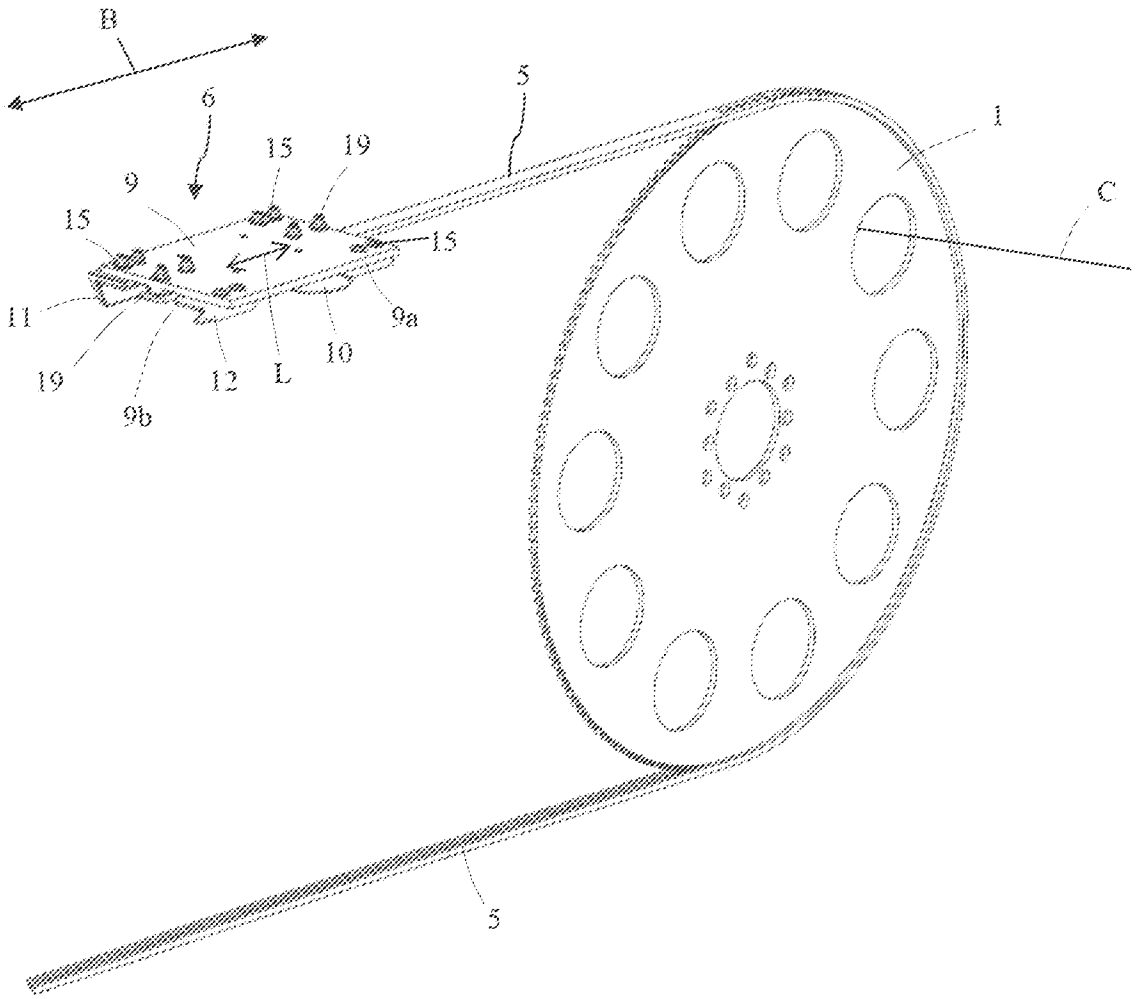
FIG. 6 represents the blade carriage and a thereto connected band in interaction with the drive gear of a cutting device according to an embodiment of the invention in perspective view.
Figures 7A, 7B:
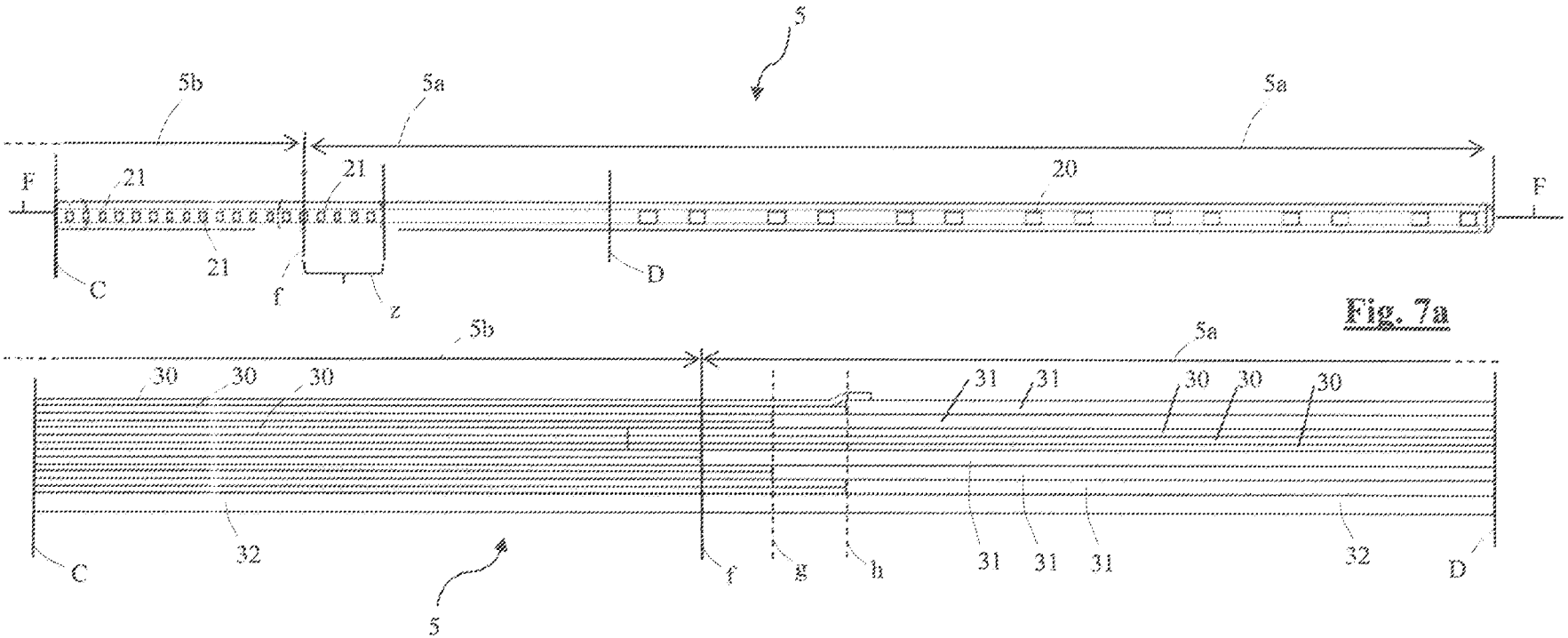
FIG. 7*a* represents a top view of the band portion which extends from the extremity of the head part up to the line C in FIG. 6.
FIG. 7*b* is a schematic cross section according to the longitudinal axis F of the band portion which in FIG. 7*a* is located between the lines C and D.

In FIG. 7*a* a top view is represented of that portion of the band (5) which extends from the extremity to which the blade carriage (6) is fastened (on the right in FIG. 7*a*) up to the line C which is indicated in FIG. 6. FIG. 7*b* is a schematic cross section according to the longitudinal direction (according to the axis F-F) of that portion of the band (5) which is found in FIG. 7*a* between the lines C and D.

The band (5) is constructed as an elongate strip having a substantially rectangular cross section whereof the width is greater than the height. The head part (5*a*) of the band (5) is provided with openings (20) for the bolts with which the blade carriage (6) is fastened to the band (5).

In the band (5), a series of openings (21) are also provided, at equal intervals, in which the teeth (2) of the drive gear (1) can be located. This row of openings (21) is located substantially in the tail part (5*b*) of the band (5) and runs through past the boundary line (f) between tail part (5*b*) and head part (5*a*) and ends with five openings (21) located in the head part (5*a*). The openings (21) in the head part (5*a*) are located in a transition zone (Z), where the band (5), to the right, is gradually less in interaction with the teeth (2) of the drive gear (1) and is also less bent over in order to follow the gearwheel periphery.

The tail part (5*b*) of the band (5) is composed (see FIG. 7*b*) of a number of layers (30) of polyester of practically equal thickness (for example 0.1 mm). The tail part (5*b*) is the part having the least stiffness.

In the head part (5*a*), the stiffness becomes incrementally greater to the right from the boundary line (f) between head part (5*a*) and tail part (5*b*) (see FIG. 7*b*). This stepwise increase in stiffness is obtained by, in the region of three successive lines (f), (g), (h), terminating a number of polyester layers (30) and replacing them by carbon fibre-reinforced layers (31), which connect to the terminating polyester layers and from there, at the same level in the band (5), run further to the right up to the extremity of the band (5). The carbon fibre-reinforced layers (31) have a thickness which is approximately double the thickness of the polyester layers (30). There is always one carbon fibre-reinforced layer (31) where there were, to the left of the line (f), (g), (h), two polyester layers (30) lying one upon the other (these are hereinafter referred to as 'pairs of polyester layers').

From the leftmost line (f), a centrally situated pair of polyester layers (30) is replaced by one centrally situated carbon fibre-reinforced layer (31). From the following line (g), two more pairs of polyester layers (30) are replaced by a respective carbon fibre-reinforced layer (31). These are located respectively above and below the centrally situated carbon fibre-reinforced layer (31). From the third line (h), finally two more pairs of polyester layers (30) are replaced by a respective carbon fibre-reinforced layer (31). These layers (31) are located still further from the central layer (31) and are respectively situated on the top side and the bottom side of the band (5). The zone between line (f) and line (h), where the stiffness of the band (5) increases incrementally towards the extremity of the head part (5*a*), can be made to coincide with the transition zone (Z) which is indicated in FIG. 7*a*.

On the bottom side of the band (5), over the total length thereof, a Teflon layer (32) is fitted, which ensures a low frictional resistance when the band (5) is displaced over the guide surface of the band guide (17) and the blade carriage guide (7).

The invention claimed is:

1. Device for cutting through pile threads on a weaving machine, comprising a cutter, which is displaceable back and forth according to a substantially rectilinear motion path, a transmission body in connection with the cutter, and a rotatable drive, which is drivable so as to rotate alternately in one and another rotational direction, wherein the drive and the transmission body are provided to interact in order to convert the rotation motions of the drive, via the transmission body, into a back-and-forth displacement of the cutter, wherein the device is provided to exert by a rotary motion of the drive, via the transmission body, a pushing force on the cutter, and wherein the transmission body is flexible over at least a portion of its length.

2. Device for cutting through pile threads on a weaving machine according to claim 1, characterized in that the drive and the transmission body are provided to displace the cutter back and forth in successive motion cycles and to exert on the cutter, during each motion cycle, alternately a pushing force and a pulling force.

3. Device for cutting through pile threads on a weaving machine according to claim 1, characterized in that the transmission body is not an endless body.

4. Device for cutting through pile threads on a weaving machine according to claim 1 characterized in that the transmission body is in interaction with one single rotatable drive.

5. Device for cutting through pile threads on a weaving machine according to claim 1, characterized in that a rotation axis of the drive is practically transversely to a direction of the motion path.

6. Device for cutting through pile threads on a weaving machine according to claim 1, characterized in that the drive comprises a rotation shaft and is driven by a motor whereof the motor shaft is practically parallel to, or lies in line with, the said rotation shaft of the drive.

7. Device for cutting through pile threads on a weaving machine according to claim 6, characterized in that the rotation of the motor shaft is transmitted either directly, or via a transmission having a transmission ratio of no more than 10, to the rotation shaft of the drive.

8. Device for cutting through pile threads on a weaving machine according to claim 1, characterized in that the transmission body is elongate and comprises at least two zones extending according to the longitudinal direction and having a mutually different stiffness.

9. Device for cutting through pile threads on a weaving machine according to claim 8, characterized in that the said zones have a different stiffness, since the transmission body has in these zones a mutually different cross section.

10. Device for cutting through pile threads on a weaving machine according to claim 8, characterized in that the transmission body comprises in at least one zone a stiffener.

11. Device for cutting through pile threads on a weaving machine according to claim 10, characterized in that the stiffener is incorporated in the basic material of the transmission body and comprises one or more stiffness-enhancing layers, wherein the one or more stiffness-enhancing layers comprise one or more fibre-reinforced layers.

12. Device for cutting through pile threads on a weaving machine according to claim 10, characterized in that the stiffener is fastened externally to the basic material of the transmission body.

13. Device for cutting through pile threads on a weaving machine according to claim 8, characterized in that the transmission body comprises at the one end a head part which is connected to the cutter, and comprises at the other end a tail part, and in that the stiffness of the head part is 15 to 100 times greater than the stiffness of the tail part.

14. Device for cutting through pile threads on a weaving machine according to claim 8, characterized in that the stiffness of the transmission body decreases gradually or incrementally from a head part up to a tail part.

15. Device for cutting through pile threads on a weaving machine according to claim 8, characterized in that the stiffness of the head part lies between 1 $N.m^2$ per metre and 500 $N.m^2$ per metre, and in that the stiffness of the tail part lies between 0.1 $N.m^2$ per metre and 1 $N.m^2$ per metre.

16. Device for cutting through pile threads on a weaving machine according to claim 1, characterized in that the cutter comprises a carrier, which is connected to the transmission body, in that the carrier carries a blade, in that the cutting device comprises a cutter guide extending according to the motion path and having a carrier guide surface on which the carrier is displaceable back and forth, and in that the carrier is provided with detainer in order to detain this carrier during its displacements with respect to the guide surface.

17. Device for cutting through pile threads on a weaving machine according to claim 1, characterized in that the device comprises a guide for keeping the transmission body in interaction with the drive.

18. Device for cutting through pile threads on a weaving machine according to claim 1, characterized in that the drive comprises a number of first engagement elements, and in that the transmission body comprises a number of second engagement elements, which are provided to interact with the first engagement elements in order to convert the rotation motions of the drive, via the transmission body, into a back-and-forth displacement of the cutter.

19. Device for cutting through pile threads on a weaving machine according to claim 18, characterized in that the second engagement elements are teeth, openings or recessed zones, and in that the first engagement elements are teeth.

20. Weaving machine comprising a device for cutting through pile threads, characterized in that it is a device according to claim 1.

21. Device for cutting through pile threads on a weaving machine according to claim 15, characterized in that the stiffness of the head part lies between, and preferably between 5 $N.m^2$ per metre and 100 $N.m^2$ per metre, and in that the stiffness of the tail part lies between 0.15 $N.m^2$ per metre and 0.5 $N.m^2$ per metre.

* * * * *